United States Patent [19]

Garcowski et al.

[11] 4,066,017

[45] Jan. 3, 1978

[54] BLANKET CLEANER FOR DUPLICATING MACHINES

[75] Inventors: Ronald J. Garcowski, Parma Heights; William A. Davis, Wickliffe, both of Ohio

[73] Assignee: Addressograph-Multigraph Corporation, Cleveland, Ohio

[21] Appl. No.: 726,941

[22] Filed: Sept. 27, 1976

Related U.S. Application Data

[63] Continuation-in-part of Ser. No. 594,208, July 9, 1975, abandoned.

[51] Int. Cl.[2] ..... B41F 35/06

[52] U.S. Cl. ..... 101/425; 15/256.5; 101/148

[58] Field of Search ..... 101/425, 148; 15/256.5, 15/256.51, 256.52, 256.53

[56] References Cited

U.S. PATENT DOCUMENTS

| | | | |
|---|---|---|---|
| 3,422,758 | 1/1969 | Brewster | 101/425 |
| 3,467,008 | 9/1969 | Domotor | 101/425 |
| 3,693,547 | 9/1972 | Morgan | 101/425 |
| 3,771,450 | 11/1973 | Cleybergh | 101/425 |
| 3,785,285 | 1/1974 | Chamben | 101/148 |
| 3,850,099 | 11/1974 | Laben | 101/425 |
| 3,874,394 | 4/1975 | Robertson | 101/425 |
| 3,897,726 | 8/1975 | Junghans | 101/425 |
| 3,926,116 | 12/1975 | Wildeman | 101/148 |
| 3,937,141 | 2/1976 | Dahlgren | 101/148 |
| 3,986,450 | 10/1976 | Zimmer | 101/425 |

*Primary Examiner*—Edgar S. Burr
*Assistant Examiner*—William Pieprz
*Attorney, Agent, or Firm*—Russell L. Root

[57] ABSTRACT

A blanket cleaning apparatus is provided for cleaning ink from a blanket cylinder of a rotary offset duplicating machine. The apparatus comprises a cleaning roller for contact with the blanket cylinder, a wiper roller and a metering roller in contact with each other and with the cleaning roller, and a wringer roller in interfering relation with the wiper roller at the zone of contact to effect deformation of the peripheral surface of the wiper roller. A cleaning fluid is supplied to the wringer roller which transfers the fluid to the wiper roller and meters the amount of fluid carried by the wiper roller to the cleaning roller for cleaning the blanket cylinder. The cleaning and the wiper rollers are driven at surface speeds differing from the surface speeds of the blanket cylinder and the cleaning roller respectively, such that the cleaning roller cleans the blanket cylinder with a scrubbing action in a minimum number of revolutions of the blanket cylinder, and the wringer roller maintains the wiper roller clean of ink and contaminated cleaning fluid for long periods without requiring cleaning maintenance of the apparatus.

16 Claims, 5 Drawing Figures

BLANKET CLEANER FOR DUPLICATING MACHINES

RELATED APPLICATIONS

This application is a continuation-in-part of copending application Ser. No. 594,208, filed July 9, 1975 now abandoned.

BACKGROUND OF THE INVENTION

Rotary offset duplicating machines include a master cylinder for supporting a master or planographic printing plate, a blanket cylinder for receiving an inked image from the master and an impression cylinder to transfer the inked image from the blanket cylinder to copy sheet. After the desired number of copies have been duplicated, the used master is removed or ejected from the master cylinder and replaced with a new master for a subsequent duplicating operation.

However, before commencing with a subsequent duplicating operation utilizing a new master, it is necessary to clean the blanket cylinder and remove the inked image deposited thereon from the previous master. This cleaning operation is normally performed by applying cleaning fluid to the blanket cylinder.

There are known devices for applying the cleaning fluid to the blanket cylinder for removing the inked image therefrom. One such device is shown in U.S. Pat. No. Re. 24,739 and includes a cleaning roller in engagement with a wick member supported in a reservoir containing cleaning fluid. As the cleaning roller is moved into rolling contact with the blanket cylinder, the cleaning roller transfers the cleaning fluid from the wick member to the blanket cylinder to remove the inked image therefrom.

Another device is disclosed in U.S. Pat. No. 3,693,547 and includes a cleaning roller in contact with a metering roller and a cylindrical wick. Cleaning fluid is transferred from the wick to the cleaning roller, and all of the rollers are movable as a unit to position the cleaning roller into and out of contact with the blanket cylinder. With the cleaning roller in cleaning contact with the blanket cylinder, the wick is held against rotation to provide a wiping or cleaning action to the cleaning roller. Thereafter, the wick is indexed to present a fresh portion thereof to the cleaning roller, and a jet of cleaning fluid is projected against the wick roller to clean its surface.

Another device is shown in U.S. Pat. No. 3,771,450 and includes a transfer roller, an axially oscillating "scrubbing" roller, both in contact with and rotating at the same surface speed as the blanket cylinder, and a metering roller in contact with both the transfer and the scrubbing rollers. Further, the device includes a wiper adapted to coact with the scrubbing roller to maintain it in a clean condition. Cleaning fluid is supplied to the rollers when they are in an operative cleaning position against the blanket cylinder and the wiper is in contact with the scrubbing roller, and the contaminated fluid is directed into a sump and carried to a collection container for subsequent disposal.

The prior art also exhibits blanket cleaners wherein there are cleaning rollers which are positively driven in a manner to produce realtive motion with respect to the blanket surface. Such devices are illustrated by U.S. Pat. Nos. 3,592,136 and 3,630,148 and British Pat. No. 1,169,668.

The blanket cleaners of the prior art worked reasonably well at a maintenance requirement level I which was adequate under many previously existing conditions where ink removal was the main consideration. Maintenance requirement level I is conceived of as a condition requiring some cleaning or treatment of the cleaner equipment by the operator, but no oftener than about once a day, e.g. 500 masters at maximum usage level. By contrast, a maintenance requirement level II is visualized as a condition in which the maintenance cleaning of the unit is required much less frequently. This would be an arrangement whereby the maintenance cleaning could be done at about 10,000 masters or more, no oftener than once a month so as to be at a frequency suited to a regular service call.

More importantly, however, a duplicating application may under some circumstances require cleaning and maintenance of the blanket cleaning unit several or even many times during a normal day's operation, when the cleaning units are of the types shown in the foregoing reference patents.

In this connection it is noted that with the advent of photoelectrostatic masters the environment changes somewhat. It was eventually found desirable, in order to have such masters print acceptably for runs which were as long as possible, to include in the moistening solution substantial quantities of additives such as glycerin (up to about 2% of glycerin for example).

With this change it was found that the existing blanket cleaning equipment represented by the prior art was no longer performing with sufficient effectiveness to be considered adequate maintenance requirement level I operation. The additives such as glycerin deposited upon the cleaning roller very rapidly, so that cleaning of the blanket cleaner equipment perhaps several or even many times a day became necessary in systems situations where many masters were run at few copies per master.

The foregoing situation consequently resulted in a highly undesirable frequency of clean-up of the blanket cleaner, and the time required to clean the unit was detracting seriously from the productivity of the equipment and the equanimity of the operator.

SUMMARY OF THE INVENTION

The present invention came about as the result of attempts to furnish blanket cleaning equipment which would take care of the problem created by the contaminating aspects of the improved moistening solutions. However, it will undoubtedly be significantly effective in dealing with problem situations arising from various other contaminating situations.

The blanket cleaner apparatus of the present invention comprises a cleaning roller adapted for contact with the blanket cylinder for removing an ink image therefrom. The cleaning roller is driven at a surface speed differing from the surface speed of the blanket cylinder and in the same rotary direction so that their engaged positions travel in opposite directions to provide a scrubbing action to the blanket cylinder to effectively and rapidly clean the blanket cylinder.

The device also includes a wiper roller in contact with the cleaning roller and with a metering roller frictionally driven by the cleaning roller. The wiper roller is preferably provided with an open-cell sponge type surface and is driven at a surface speed differing from the surface speed of the cleaning roller and in the same rotary direction so that their engaged portions travel in opposite directions. In the preferred form, a wringer roller is provided in interfering peripheral engagement with the sponge surface of the wiper roller and is frictionally driven thereby, for applying and metering the amount of fluid carried by the wiper roller to the cleaning roller and, also, to maintain the wiper roller clean. Thus, the wiper roller provides a combined scrubbing-wiping action to both the cleaning and metering rollers to maintain the rollers free from contamination resulting from cleaning the ink image from the blanket cylinder and from dampening fluid deposits, and the wringer roller maintains the wiper roller clean, prevents slinging of the cleaning fluid during operation of the device and meters the fluid carried by the wiper roller, while the metering roller also contributes to maintaining the wiper roller surface clean by running thereagainst at a different surface speed.

A cleaning fluid is supplied to the wringer roller for transfer via the wiper roller to the cleaning roller and thence to the surface of the blanket cylinder, and the metering roller is adjustable relative to the cleaning roller to control the amount of cleaning fluid carried by the cleaning roller to the blanket cylinder. Upon removal of the inked image from the blanket cylinder, the contaminated cleaning fluid is directed to a trough and from there it is drained, settled, and recycled to provide substantially clean fluid to the rollers for each cleaning operation of the blanket cylinder.

It is an object of the present invention to provide an improved blanket cleaner apparatus for effectively and rapidly removing an ink image from the blanket cylinder of a rotary offset duplicator in only a minimum number of revolutions of the blanket cylinder.

Another object of the invention is to provide a blanket cleaner apparatus comprising a roller arrangement that maintains the apparatus in a clean condition for long periods thereby requiring only minimal cleaning maintenance of the apparatus.

Another object is to provide for recylcing of the cleaning fluid to provide substantially uncontaminated fluid to the cleaning roller for each cleaning operation of the blanket cylinder, and to apply to the blanket only a minimum amount of cleaning fluid to assure quick drying of the blanket and less chance of contaminating the duplicating machine.

Another object is to provide a wiper roller of sponge material, driven at a surface speed differing from the surface speed of the cleaning roller and in opposite directions at their point of contact, in contact with the cleaning roller and the metering roller for maintaining the rollers clean and free from ink contamination resulting from removal of the inked image from the blanket cylinder.

Another object is to provide a wringer roller in overlapping relation with the wiper roller at the zone of contact to effect deformation of the peripheral surface of the wiper roller for metering the fluid carried by the wiper roller, maintaining the wiper roller clean for long periods prior to requiring cleaning maintenance of the apparatus and to avoid slinging of the fluid.

A feature of the invention is to provide an economically manufacturable blanket cleaner apparatus for quickly and reliably cleaning the blanket cylinder of an offset duplicating machine.

Other objects, features and advantages of the invention will appear hereinafter as the description proceeds.

IN THE DRAWING

DESCRIPTION OF THE PREFERRED EMBODIMENT

Figure 1:
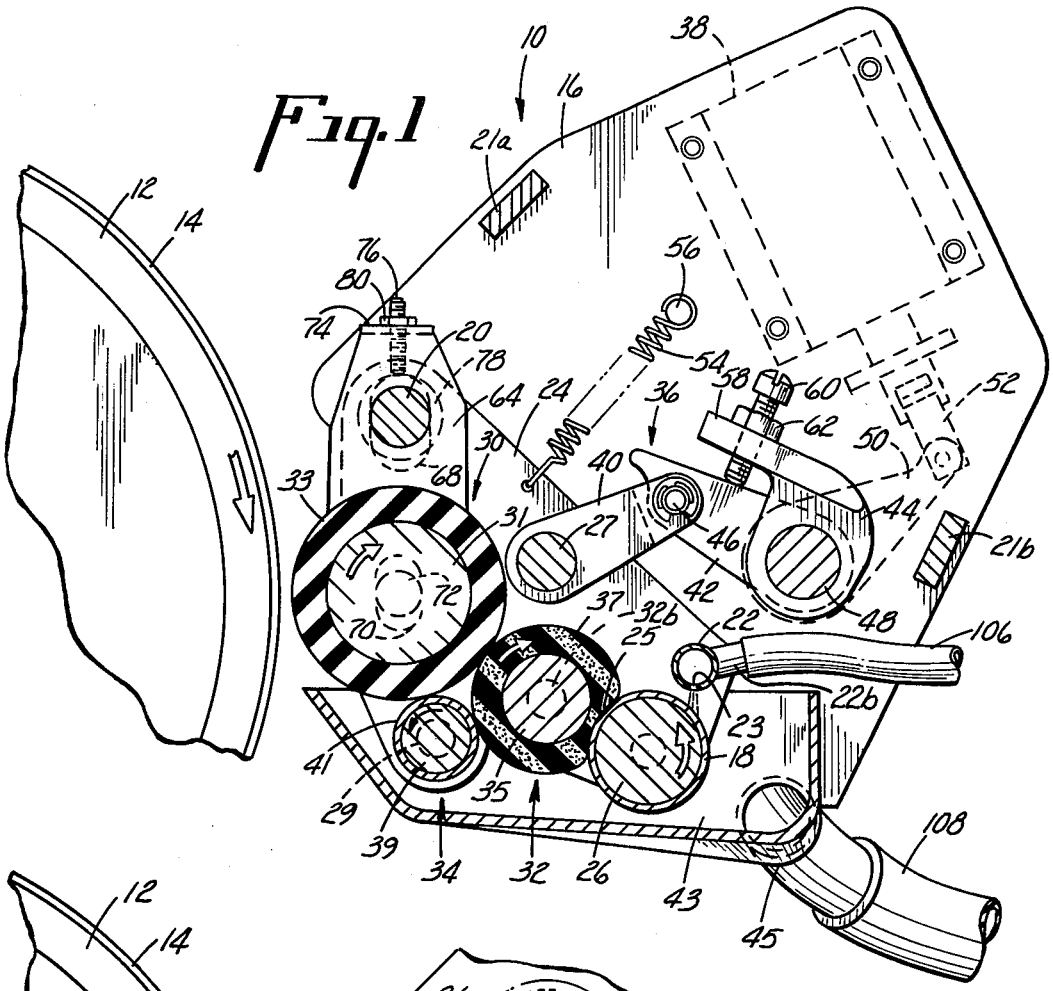
FIG. 1 is a central section taken from one side of a preferred embodiment of a blanket cleaner unit in accordance with the present invention with the gears omitted for clarity.

As shown in FIG. 1, the blanket cleaning unit is indicated generally by the reference numeral 10 in association with a blanket cylinder 12 having an offset blanket 14 secured to its outer surface in a known manner. Although not shown in the drawing, the cylinder 12 is conventionally mounted for rotation in a frame of a printing or duplicating machine and driven from a suitable power source. An inked image is transferred to the blanket 14 from a lithographic master and from the blanket to a copy sheet in the usual manner. As shown in FIG. 1, the cylinder 12 generally is positioned so that the surface of the blanket 14 is accessible for cleaning, either from the front or the rear of the machine.

In the preferred embodiment shown in FIG. 1, the cleaning unit 10 includes a first or main frame comprising a pair of first side plates, only one side plate 16 being shown in the drawing, held together in spaced apart relation by a rod 20 and tie bars **21*a* and 21*b*. A pair of auxiliary side plates, only one auxiliary side plate 24 being shown in the drawing, are positioned adjacent the inside faces of the first plates and rotatably support a cleaning roller 30, a wiper roller 32 and a wringer roller 26. The auxiliary side plates define a second or auxiliary frame for rotatably supporting the rollers 30, 32 and 26, and the entire apparatus can be readily removed from and mounted on the duplicating machine as an integral unit. As shown in FIG. 1, the auxiliary side plates are held in spaced relation by a bar 27 and a spray tube 22, and are pivotally supported on the rod 20 for controlled movement by a pair of actuating means 36, only one of which is shown in FIG. 1, in response to energization of a solenoid 38 mounted on the side plate 16**.

The cleaning unit 10 also includes a trough 43 positioned beneath the rollers 26, 30 and 32 and a metering roller 34, extending between the first side plates, for receiving and draining contaminated cleaning fluid during a cleaning operation for removal of an ink image from the blanket 14.

The cleaning roller 30 comprises a metal core 31 having an elastomeric cover 33 conventionally secured to it. Preferably, the cover 33 comprises a nitrile base rubber of about 20–25 durometer and extends axially a distance overlapping slightly the marginal edges of the blanket 14. The wiper roller 32 includes an axle **32*b* and a metal core 35 having a cover 37 comprising a nitrile base sponge of open-cell structure secured to it. More specifically, the cover material is available from the American Roller Company and is identified as an open-cell polyester urethane foam, prototype number 977.05-1. The cover 37 is positioned in engagement with the cleaning roller 30 and extends axially a distance corresponding substantially to the length of the cover 33 of the cleaning roller 30**.

The metering roller 34 comprises a metal core 39 having a cover 41 thereon of polytetrafluoroethylene and, as such, displays a substantially non-compressible surface. The metering roller is positioned in contact with both the cleaning roller 30 and the wiper roller 32 and is frictionally driven by the cleaning roller 30. The cover 41 also extends axially a distance corresponding substantially to the length of the cover 33 of the cleaning roller 30.

The wringer roller 26 is frictionally driven by the wiper roller 32 and comprises a metal core having a cover 18 thereon of polytetrafluorethylene and, as such, displays a substantially non-compressible surface. The wringer roller is positioned in interfering relation with the wiper roller 32 so as to be in compressing engagement with the sponge surface thereof at the zone of contact defining a working surface 25 to effect deformation of the peripheral surface of the wiper roller 32 as shown in FIG. 1. The cover 18 also extends axially a distance corresponding substantially to the length of the cover 33 of the cleaning roller 30. This arrangement of the wringer roller 26 is such as to provide a substantial squeeze or wringing action to the wiper roller 32 to effect cleaning of the wiper roller at the working surface 25, to prevent an excessive build-up of cleaning fluid on the wiper roller 32 and thereby to avoid slinging of the fluid. As shown in FIG. 1, the spray tube 22 is mounted in the auxiliary side plates and is positioned to direct the cleaning fluid onto the surface of the wringer roller 26, thereby feeding the cleaning fluid to the wiper roller 32 which conveys the fluid to the cleaning roller 30 in a limited amount so as to avoid undesirable splashing or slinging of the cleaning fluid.

As best shown in FIG. 1, the actuating means 36 for pivoting the second frame, and thereby moving the cleaning roller 30 into and out of engagement with the blanket 14, comprises a toggle mechanism including a link 40 and an arm 42, and an adjusting member 44. Preferably there is provided a pair of actuating means 36, one at each end of the cleaning unit 10, although only one actuating means is shown in the drawing. However, because both actuating means 36 are identical, only one actuating means will be described herein.

The link 40 is pivotally supported at one end on the bar 27 and at its other end is pivotally connected to the arm 42 by a pin 46. The arm 42 is pivotally supported at its other end on a shaft 48 rotatably supported in the first side plates.

One end of the shaft 48 extends outwardly beyond the side plate 16 and has affixed thereon a lever 50. The lever 50 has its end secured to a plunger 52 of the solenoid 38. The system is biased in a direction such that the auxiliary frame and the cleaning roller 30 are held away from the blanket cylinder, the lever 50 is in its most clockwise position (FIG. 1) and the solenoid plunger 52 is extended. This is all due to a tension spring 54 extending from the auxiliary side plate 24 to a perch 56 on the main frame.

The adjusting member 44 is fixed on the shaft 48 and includes an extension 58 provided with a threaded hole therein for receiving a screw 60. The screw projects through the extension 58 and the end of the screw is adapted to coact with the arm 42 for adjusting the link 40 and the arm 42, by lowering the pin 46 or raising the pin by the bias of the spring 54, thereby adjusting the pressure contact of the cleaning roller 30 against the blanket on the cylinder 12 when the cleaning roller is in operative position. When the final adjustment is made, the screw 60 is held in the set position by a lock nut 62. In response to energization of the solenoid 38, the lever 50 is caused to pivot against the biasing action of the spring 54 thereby rocking the shaft 48, lowering the pivot pin 46 and urging the link 40 outwardly, or to the left as viewed in FIG. 1. This action pivots the auxiliary frame in a clockwise direction about the rod 20 to move the cleaning roller 30 to an active position in contact or cleaning engagement with the blanket 14. When the solenoid 38 is de-energized, the parts are moved in opposite directions by the spring 54 to thereby restore the mechanism to an inactive position with the cleaning roller 30 out of contact with the blanket cylinder as shown in FIG. 1.

In order to obtain the proper amount of pressure contact between the cleaning roller 30 and the blanket 14 to effectively remove an ink image from the blanket, the position of arms 42 may be set by adjusting screw 60, to thereby lower or raise the pivot pins 46.

In practice the screws 60 on both sides of the machine would be backed off and then the solenoid placed in fully actuated position. The screws 60 would then be tightened until the roller 30 is in light touching contact with the blanket throughout its length. Then the screws 60 are further advanced an equal amount to apply uniform cleaning pressure.

Adjustment of the contact pressure between the metering roller 34 and the cleaning roller 30 is effected by a pair of slides, only one slide 64 being shown in the drawing, positioned at opposite ends of the rod 20 and rotatably supporting an axle 29 of the metering roller 34. Because both slides are identical, only one will be described herein.

The slide 64 is provided with a pair of elongate clearance openings 68 and 70 for receiving therein respectively, the rod 20 and an axle 72 of the cleaning roller 30. The upper portion of the slide 64 is provided with a formed ear 74 having a threaded hole therein for receiving a screw 76. A spacer or collar 78 is mounted on the rod 20, intermediate the side plate 16 and the auxiliary side plate 24 and, but rotating the screw 76 acting against the collar 78, the slide 64 is raised or lowered, as permitted by the elongate clearance openings 68 and 70, to position the metering roller 34, supported in the slides, towards or away from the cleaning roller 30. Once the metering roller 34 is set at the desired position, the screw 76 is locked in place with a lock nut 80.

Because the slides supporting the metering roller 34 are mounted on the second frame, as are the cleaning, wiper and wringer roller 30, 32 and 26 respectively, all of the rollers 26,-30, 32 and 34 are moved as an integral unit when the second frame is moved between the inactive and active positions.

Figure 2:
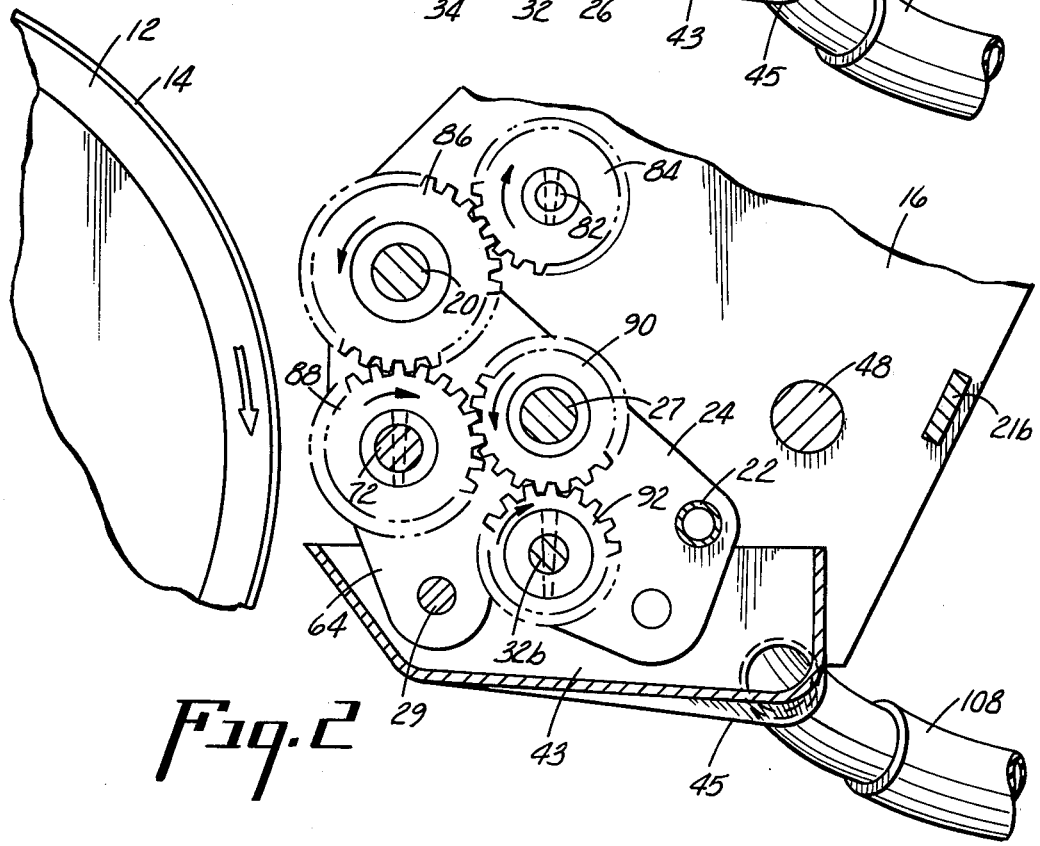
FIG. 2 is a section taken on a different plane from that of FIG. 1 showing the gear drive means for the various rollers of the blanket cleaner unit.

The drive arrangement of the various rollers is shown in FIG. 2 and comprises a drive shaft 82 driven by a suitable power source, such as an electric motor, not shown in the drawing. The shaft 82 extends through the side plate 16 and has a gear 84 secured thereon for rotation in a clockwise direction as viewed in FIG. 2. The gear 84 meshes with a gear 86 rotatable on the rod 20, and the gear 86 drives a gear 88, secured at one end of the cleaning roller axle 72, in a clockwise or the same direction of rotation as the cylinder 12 as indicated by the arrows in FIGS. 1 and 2. An idler gear 90 is rotatably supported on the bar 27 and is driven by the gear 88 and is also in mesh with a gear 92 fixed on the wiper roller axle **32*b* to dirve the wiper roller in a clockwise or the same direction of rotation as the gear 88**.

Hence, the blanket cylinder 12, the cleaning roller 30 for contact with the cylinder 12, and the wiper roller 32 in contact with the cleaning roller, are all driven in the same direction of rotation so that in their mutually contacting zones their peripheral movement is oppositely directed. The metering roller 34, as mentioned supra, is in contact with the cleaning roller 30 and the wiper roller 32 and the contact pressure differences of the rollers causes the metering roller 34 to be frictionally rotated by the cleaning roller 30. Also as mentioned supra, the wringer roller 26 is frictionally driven by the wiper roller 32.

Although the wiper roller 32 could be driven in a direction of rotation opposite the direction of rotation of the cleaning roller 30, such that in their mutually contacting zone their peripheral movement is in the same direction, driving the wiper roller and the cleaning roller in the same rotary direction as described supra, provides greater scrubbing action to the cleaning roller to maintain it clean of ink pigments and dampening fluid deposits and to permit cleaning of the blanket 14 in a minimum number of cylinder revolutions.

In addition to the surface motion of the various rollers in opposite directions in their zones of contact, in order to provide adequate scrubbing action between the cleaning roller 30 and the blanket 14 to effectively remove an ink image from the blanket in only a minimum number of cylinder revolutions, the cleaning roller 30 and the cylinder 12 are driven at speeds such that their relative surface speed difference will be within a suitable predetermined range of values. Also, the surface speed difference betweeen it and the cleaning roller 30 will be within a suitable predetermined range of values to provide a similar scrubbing action to the cleaning roller to maintain it free of ink contamination from cleaning the blanket. These differential speed values are discussed in detail hereinafter. The wiper roller 32 and the wringer roller 26 also maintain the metering roller 34 and the wiper roller 32 respectively, clean and free from build-up of fountain solution products from the duplicating machine which normally tend to accumulate at the nip of the cleaning and metering rollers.

The operation of the blanket cleaner of the present invention relies importantly on the creation of a surface speed difference between the blanket cylinder and the cleaning roller, in excess of the generally effective cleaning threshold surface speed difference and experimentation has shown the threshold surface speed difference to be about 80 in/sec (200 cm/sec). It is known, of course, that surface speed differences have been used heretofore apparently in an attempt to expedite the removal of the ink alone from the blanket. In the present situation, however, the threshold surface speed difference is an essential ingredient of the effective combination. This seems to be because the contaminants must also be removed, and since they are not so readily handled as the ink, being immiscible with the solvents in the normal cleaning solutions used for ink, it is surmised that they resist treatment by such solvents when removal from the blanket surface or other surfaces is attempted by procedures which rely primarly on mere solvent application.

It has been found that the threshold surface speed difference referred to above is quite effective in releasing such contaminants from the blanket and carrying them along with the dissolved ink onto the cleaning roller surface.

It was also discovered, however, that adequate release of the contaminants from the blanket surface was not enough by itself to restore the equipment to the maintance requirement level I condition referred to supra, because the cleaning roller would soon become contaminated to such a degree that its cleaning action upon the blanket became erratic, requiring a delay to clean its surface and restore its effectiveness. Similar results with only slight improvement can be obtained by allowing a fixed sponge or wick to wipe against the cleaning roller which is in contact with the blanket under a threshold surface speed difference.

What was finally discovered was that the use of the wiper roller acting against the surface of the cleaning roller with a threshold surface speed difference as referred to above was capable of keeping both itself and the cleaning roller free of contaminants to the point that the maintenance requirement level I condition was again obtainable in spite of the presence of glycerin or other contaminants related to the use of photoelectrostatic masters on the master cylinder.

In addition to the foregoing it was further discovered that by maintaining a value of surface speed difference between the cleaning roller and the wiper roller, somewhat elevated above the "threshold surface speed difference" identified above, e.g. at about 100 in/sec (250 cm/sec), it is possible to have continuous operation of the equipment for extended periods, maintenance requirment level II operation, of one month or more (e.g., 10,000 masters under maximum usage conditions) between cleaning operations which would put the cleaning of the blanket cleaner module easily into a service call category rather than being an operator function.

In the invention described herein, the roller or cylinder members and roller nips which have threshold surface speed differences are described as having the members rotate in the same sense, so that their adjacent surfaces are traveling in opposite directions. While this is not absolutely essential to obtain the surface speed differences which are envisioned, as a practical matter it is much to be preferred that the surface speed differences be obtained in this fashion. The speed differences being dealt with are great enough that a rather high rotary speed of one member would be required if their adjacent surfaces were moving in the same direction, and such high rotary speeds are normally to be avoided in the interests of minimizing slinging of the cleaning fluid.

In practice, extremely good results were obtained by utilizing a cylinder 12 having a diameter of 6.000 inches (15.24 cm.), including the thickness of the blanket 14, a cleaning roller 30 having a diameter of b 1.437 inches (3.65 cm.), a wiper roller 32 having a diameter of 1.000 inch (2.54 cm.), a metering roller 34 having a diameter of .562 inch (1.43 cm.) and a wringer roller 26 having a diameter of .812 inch (2.06 cm.). With the cylinder 12 driven at 150 RPM, the cleaning roller 30 at 875 RPM, the wiper roller 32 at 900 RPM, the metering roller 34 frictionally driven by the cleaning roller 30 and the wringer roller 26 frictionally driven by the wiper roller 32, the blanket 14 was cleaned and the ink image thereon completely removed in just three revolutions of the cylinder 12.

The cleaning unit 10 could be designed with a cylinder and rollers of other dimensions and driven at other velocities and still provide the required scrubbing action to clean the blanket as disclosed herein, provided that the scrubbing rate or surface speed differences of the cylinder and the rollers is maintained somewhat in accordance with the foregoing description. Thus, in the illustrated embodiment, the individual surface speeds may be calculated as follows:

surface speed of cylinder 12 = $\pi d \cdot RPM = 18.84 \cdot 150 = 47$ in/sec (120 cm/sec)

surface speed of cleaning roller 30 = $\pi d \cdot RPM = 4.512 \cdot 875 = 66$ in/sec (168 cm/sec)

surface speed of wiper roller 32 = $\pi d \cdot RPM = 3.14 \cdot 900 = 47$ in/sec (120 cm/sec)

To calculate the scrubbing rate or surface speed differences, cylinder 12 and rollers 30 and 32 may be considered as rotating in a positive direction and roller 34 in a negative direction. At the nip between positively rotating rollers the surface speeds are, of course, additive since the surfaces are there travelling in opposite directions. At the nip between rollers of opposite rotational sign the speeds are subtractive since the rollers are there travelling in the same direction. Thus the surface speed differences are calculated as follows:

between cylinder 12 and cleaning roller 30 = 47 + 66 = 113 in/sec (287 cm/sec)

between wiper roller 32 and cleaning roller 30 = 47 + 66 = 113 in/sec (287 cm/sec)

between metering roller 34 and wiper roller 32 = 66 − 47 = 19 in/sec (48 cm/sec)

While the foregoing arrangement has been found to provide optimum results, other surface speed differences within a reasonable range could be provided with substantially equivalent results. Thus, experimentation has shown that while the wiper roller 32 could be driven at about 500 RPM resulting in a surface speed less than that of the cleaning roller 30 to provide a difference therebetween of about 92 in/sec (230 cm/sec), and still provide for cleaning of the blanket in a minimum number of cylinder revolutions, it was necessary to remove and clean the unit 10 after running between 1000 – 1500 masters. On the other hand, with the wiper roller 32 driven at a surface speed greater than the cleaning roller 30 as stated above, i.e. at a surface speed difference of 113 in/sec (287 cm/sec), and with the wringer roller 26 coacting with the wiper roller 32, more than 15,000 masters (maintenance requirement level II) could be run without the blanket cleaner unit's requiring cleaning maintenance. This is not to be understood as a limiting figure since it was not necessary or practical to continue testing to make precise determinations as to how many more masters it would take to put the equipment in a condition where cleaning was needed.

In practice it has been found that the blanket cleaner units of the prior art normally require cleaning at least as often as about every 500 masters, or even much oftener when the improved moisture solutions for photoelectrostatic masters are employed. On the other hand the blanket cleaner unit of the present invention, even through operating in the environment of the improved moisture solutions for photoelectrostatic masters, requires cleaning maintenance no oftener than every 500 masters, and under the optimum surface speed conditions identified above will require cleaning maintenance no more frequently than every 15,000 masters, and often will go much longer than that before requiring cleaning.

The cleaning roller 30 could also be driven at a surface speed differing from that of the cylinder 12 by less than the 113 in/sec (287 cm/sec) shown in the above example. The surface speed differences between the cylinder 12 and the cleaning roller 30 to permit effective cleaning of the blanket in only three revolutions of the cylinder, and between the wiper roller 32 and the cleaning roller 30 to provide for only minimal cleaning maintenance of the cleaning unit 10 (based on 800 RPM of the wiper roller 32 and 800 RPM of the cleaning roller 30 in the example given above) are considered as follows:

between cylinder 12 and cleaning roller 30, 107 in/sec (272 cm/sec)

between wiper roller 32 and cleaning roller 30, 102 in/sec (260 cm/sec)

Figure 3:
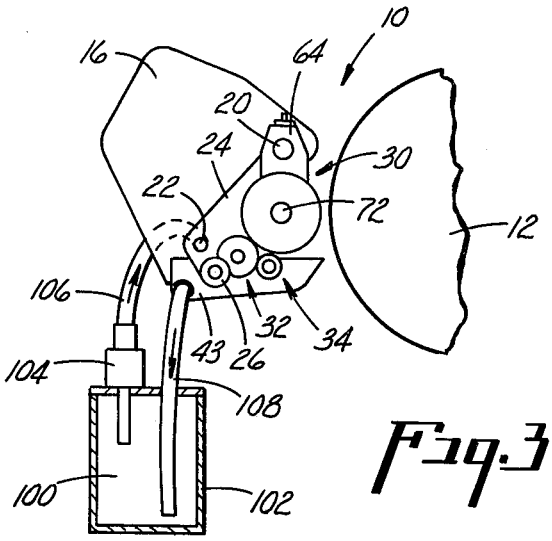
FIG. 3 is a schematic elevation showing a cleaning fluid recycling device in association with the blanket cleaner unit of FIG. 1 viewed from the opposite side.

With reference to FIG. 3, there is shown an arrangement for recycling cleaning fluid 100 between a supply container 102 and the cleaner unit 10. During a blanket cleaning operation, in response to movement of the cleaning roller 30 into cleaning engagement with the cylinder 12, a pump 104, which normally is continuously operative during operation of the duplicating machine, supplies cleaning fluid 100 from the container 102 via an entrance conduit 106 to the spray tube 22 through a nipple **22*b* (FIG. 1) As shown in FIG. 1, the spray tube 22 is provided with a series of openings 23 facing the surface of the wringer roller 26 for projecting jets of cleaning fluid onto the wringer roller. The jets are so directed that they flush the side of the wringer roller away from the wiper roller and avoid directing fluid into the nip where it can be readily absorbed by the sponge cover 37 of the wiper roller in undue amount. As the rollers are rotated, the metering roller 34 controls the amount of fluid carried by the cleaning roller 30 to the blanket 14, the wringer roller 26 carries fluid to the wiper roller 32 and simultaneously, by its heavy squeezing or wringing action, meters or controls the amount of fluid taken up by the wiper roller 32 for carrying to the cleaning roller 30, and thus prevents slinging of excess fluid from the surface of the rapidly rotating wiper roller. Moreover, the wiper and the wringer rollers 32 and 26 respectively, maintain the cleaning roller and the wiper roller respectively, free of ink pigments and sludge resulting from removal of the ink image from the blanket. The metering roller is also maintained substantially free of fountain solution build-up by the continual wiping contact of the wiper roller, and the latter is prevented from having the fountain solution residues build up in its pores by the continual working action to which it is subjected by the wringer roller, whereby these residues are drained off with the used cleaning fluid and allowed to settle out in the container 102**.

In addition, the polytetrafluoroethylene cover 41 on the metering roller 34, and the similar cover 18 preferably used on the wringer roller 26 are found to contribute very materially to the ability of these surfaces to resist accumulation of deposits of any kind and especialy those resulting from dampening fluid residue.

The contaminated fluid from cleaning the image from the blanket 14 and the cleaning roller 30, and wrung from the wiper roller 32, is received in the trough 43 provided with a sloped bottom surface 45 (FIG. 1) for draining the contaminated fluid from the trough via a drain conduit 108 to the container 102. As shown in FIG. 3, the drain conduit 108 terminates adjacent the bottom of the container 102 while the entrance conduit 106 terminates at a position about midway of the level of the fluid 100 in the container. In this way, the heavier ink particles, sludge and the like carried by the contaminated fluid are caused to settle at the bottom of the container 102, and substantially uncontaminated cleaning fluid 100 is supplied from near the top of the container to the rollers for each cleaning operation of the blanket 14.

In the operation of the cleaner unit 10, the unit normally would be mounted on a sequence controlled or automated duplicator in which operations such as master insertion, master ejection, blanket cleaning, etc., are performed automatically at selected times in the sequence of operations. Thus, in response to a signal from the duplicator indicating that the blanket cleaning operation is to be performed, the power source for driving the rollers is activated, the solenoid 38 is energized and, through the rocker 50 and the link 40 and arm 42, pivots the auxiliary side plates to move the cleaning roller 30 into contact engagement with the blanket 14 on the cylinder 12. The continuously running pump 104 supplies cleaning fluid 100 to the surface of the wringer roller 26 for transfer to the wiper roller 32 and the cleaning roller. While it is found most practical in systems duplicators to use a continuously running pump, it will be understood that, if desired, a pump start and stop control activated by the above-mentioned signal can be used for special applications.

The cleaning roller remains in engagement with the blanket for a fixed number of revolutions of the cylinder 12 for removing the ink image from the blanket. Thereafter, the solenoid 38 is deenergized to pivot the auxiliary side plates and the rollers to the inactive position in which the cleaning roller 30 is out of engagement with the cylinder 12 as shown in FIG. 1, the power source for driving the rollers is de-activated and the contaminated fluid, resulting from cleaning the blanket, drains from the trough into the supply container 102. At this point of operation the blanket is clean and in condition to receive, after momentary drying, a new inked image from a subsequent master. The rollers are likewise clean and in readiness for the next cleaning operation of the blanket.

Figure 4:
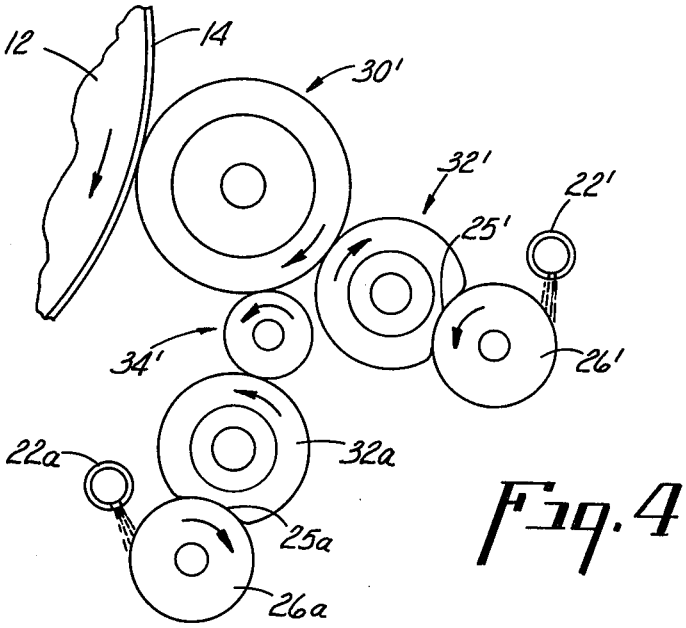
FIG. 4 is a schematic elevation of an alternate embodiment of a roller configuration for a blanket cleaner unit according to the invention.

An alternate embodiment is shown in FIG. 4 and illustrates another way in which the invention can be carried out. Shown are a cleaning roller 30', a wiper roller 32', a metering roller 34', and a wringer roller 26' corresponding to the rollers 30, 32, 34 and 26 respectively, but with the metering roller 34' spaced from the wiper roller 32'. Additionally, there is shown a second wiper roller **32*a* in contact with the metering roller 34' and a second wringer roller 26*a* in comprising engagement with the periphery of the wiper roller 32*a* to provide a working surface 25*a* corresponding to a working surface 25' afforded by the interfering relation of the wringer and wiper rollers 26' and 32'** respectively.

The wiper roller **32*a* is constructed of the same material and is driven in the same manner and surface speed as the wiper rollers 32 and 32', and the wringer roller 26*a* is constructed of the same material and is frictionally driven in the same manner as the wringer rollers 26 and 26'. Also, a spray tube 22*a* is provided for supplying cleaning fluid to the surface of the wringer roller 26*a* and a spray tube 22' is provided for supplying cleaning fluid to the surface of the wringer roller 26'**.

With such an arrangement, the wringer rollers 26' and **26*a* are effective to meter the cleaning fluid on the wiper rollers 32' and 32*a* respectively, to provide only that needed for the cleaning operation and, as a result of the action at the working surfaces 25' and 25*a*, tend to maintain the wiper rollers 32' and 32*a* clean and free of contamination resulting from the blanket cleaning operation. It will be noted that at the surfaces 25' and 25*a* there is actually a surface speed difference which provides a scrubbing action as the wiper roller changes radius, which action serves to continuously clean the wiper roller surface. While the use of wringer rollers is preferred, it will be understood that line contact rollers driven at a different surface speed from the wiper rollers in place of rollers 26' and 26*a*** would exhibit equal continuous cleaning effectiveness.

Figure 5:
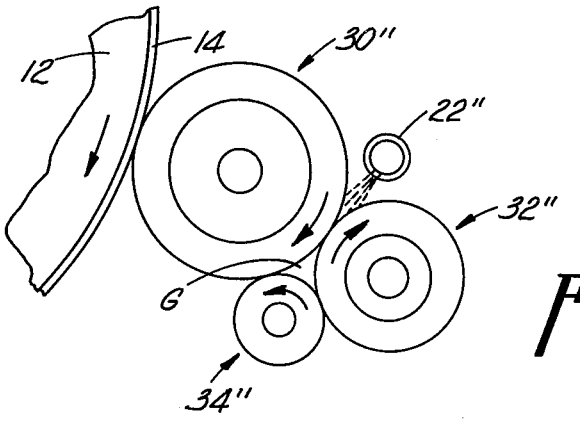
FIG. 5 is a schematic elevation of another alternate embodiment of a roller configuration for a blanket cleaner unit according to the invention.

The embodiment shown in FIG. 5 is similar to the embodiment of FIG. 1 but does not include the wringer roller 26 of FIG. 1. Thus, the FIG. 5 device comprises a cleaning roller 30'', a wiper roller 32'' and a metering roller 34'' in contact with both of the rollers 30'' and 32''. As with the other embodiments, the rollers 30'', 32'' and 34'' of the FIG. 5 device are constructed of the same materials and are driven in the same manner and surface speeds as the corresponding rollers 30, 32 and 34 respectively, of the device shown in FIG. 1. Also provided is a spray tube 22'' for supplying cleaning fluid to the nip of the rollers 30'' and 32''.

While this arrangement is effective to clean the blanket in a minimum number of cylinder revolutions, and also maintains the unit free of cleaning maintenance for equally long periods or maintenance requirement level II, it has been found that its handling of the cleaning fluid supply is such that it can prevent slinging of the fluid only when the axial length of the cover of the wiper roller 32'' is approximately 20% shorter than the axial length of the covers of the cleaning roller 30'' and the metering roller 34''. It is believed that this arrangement provides an escape route for cleaning fluid accumulating in a gap (indicated by the reference character G in FIG. 5) between the rollers before the excess can reach the ends of the rollers 30'' and 34''.

The arrangement shown in FIG. 5 provides all of the benefits of the invention in a very simple mechanical system in cases where the design will permit the construction of rollers 30'' and 34'' with the extra length extending beyond the operative printing width of the blanket.

Thus, while each of the alternate embodiments described supra, provide certain advantages over known devices insofar as cleaning the blanket in a minimum number of cylinder revolutions and long periods of operation without requiring cleaning maintenance, the FIG. 4 device requires several parts in addition to those included in the preferred embodiment, but is shown and described since it serves perhaps to illustrate more graphically the process being performed by the condensed versions shown in FIGS. 1 and 5.

The advantages achieved by the device of the preferred embodiment shown in FIG. 1 utilizing only a minimum number of components, result from the use of the wringer roller 26 acting against the periphery of the wiper roller 32. This arrangement meters the amount of fluid passed through the roller system and transferred to the wiper roller, limiting it to only the amount needed to clean the blanket and thereby preventing slinging of the fluid. The squeezing action of the wringer roller 26 upon the working surface 25 also tends to aid the not only its own scrubbing action due to compression and expansion movement of the cover 37 on roller 32 but also the scrubbing action of metering roller 34 in maintaining the surface of the wiper roller clean by continually breaking up any forming accumulations.

Further, the wiper roller 32 can be provided with a cover extending axially a distance corresponding substantially to the length of the other rollers while avoiding slinging of fluid outwardly from the ends of the rollers. Accordingly, the invention provides a unit wherein the blanket 14 can be cleaned quickly, and wherein the rollers do not require manual cleaning maintenance at frequent intervals as is customary with known blanket cleaner units.

The form of the invention shown in FIG. 4 represents a configuration in which the continual cleaning of the cleaning roller and the continual cleaning of the metering roller are individually accomplished by separate roller trains, while the FIG. 1 and FIG. 5 arrangements show how the functions can be consolidated into a single roller train whereby the wiper roller is responsible for the continual cleaning of both surfaces. Moreover, in the arrangements shown in FIGS. 1 and 5, the continual cleaning at the nip between the wiper roller and the metering roller provides a mutual cleaning action by which the wiper roller is also continuously cleaned due to the rubbing action between it and the metering roller because of surface speed difference present.

Thus, in all three forms of the invention shown and described, there is provided a cleaning means in rubbing surface contact with the wiper roller for preventing accumulation of deposits on its surface. In the FIG. 5 form this means is the metering roller 34'', in the FIG. 4 form, the wringer rollers 26', **26*a*, and in the preferred FIG. 1 form a combination of the metering roller 34 and the wringer roller 26**.

To summarize, the present invention provides novel blanket cleaning equipment which is capable of maintenance requirement level I operation even under conditions rendered adverse by the preferred moistening materials used for photoelectrostatic masters. This result is made possible by reason of the presence of a wiper roller having rubbing contact with the surface of the cleaning roller and also with a further member against which it cleans itself, and because the operating speeds are so arranged that at the nip between the blanket cylinder and the cleaning roller and the nip between the cleaning roller and the wiper roller there exists a threshold surface speed difference of at least about 80 in/sec (200 cm/sec). In addition when the surface speed difference between the wiper roller and the cleaning roller of this invention is adjusted to at least about 100 in/sec (250 cm/sec) the device of the invention is capable of maintenance requirement level II operation.

What is claimed is:

1. A printing machine, comprising:

a rotary blanket cylinder driven at a predetermined surface speed;

a frame movably mounted on the printing machine adjacent the cylinder;

a cleaning roller rotatably supported by the frame in a position for forming a first nip with the cylinder to perform a cleaning operation;

a wiper roller having an open-cell sponge cover rotatably supported by the frame in contact with the cleaning roller and forming a second nip therewith;

means for continuously rotating both of said cleaning and wiper rollers at speeds such that the difference in surface speeds of the rollers at each nip is at least about 200 cm/sec;

cleaning means comprising a continuously rotating roller having a substantially non-compressible surface in rubbing surface contact with the wiper roller for preventing accumulation of deposits on the surface thereof; and means for supplying cleaning fluid to the surface of the cleaning roller.

2. A printing machine as set forth in claim 1 in which the cleaning means comprises a wringer roller; and further comprising:

a metering roller in contact with the cleaning roller;

a second wiper roller in contact with the metering roller; and a second wringer roller in contact with the second wiper roller.

3. A printing machine as set forth in claim 1 in which the cleaning roller is provided with an elastomeric peripheral cover comprising a nitrile base rubber.

4. A printing machine as set forth in claim 1 further comprising: trough means for draining contaminated fluid resulting from a cleaning operation of the cylinder: and means for receiving the contaminated fluid, settling the contaminants therefrom, and recycling the same to supply substantially uncontaminated cleaning fluid to the cleaning roller for each cleaning operation of the cylinder.

5. A printing machine as set forth in claim 1 further comprising:

a metering roller in contact with the cleaning roller;

means for adjusting the contact pressure of the cleaning roller relative to the cylinder; and means for adjusting the contact pressure of the metering roller relative to the cleaning roller.

6. A printing machine as set forth in claim 1 in which the cleaning means comprises a metering roller frictionally driven by the cleaning roller.

7. A printing machine as set forth in claim 1 in which the cleaning means comprises a wringer roller in compressing engagement with the sponge cover, and said fluid supplying means includes means for applying the fluid to the surface of the wringer roller.

8. A printing machine as set forth in claim 7 in which the cleaning means further comprises a metering roller in fluid metering contact with the cleaning roller and in mutual cleaning contact with the wiper roller.

9. A printing machine as set forth in claim 8 in which the metering roller controls the amount of cleaning fluid carried by the cleaning roller to the cylinder, and the metering roller is provided with a peripheral cover comprising polytetrafluoroethylene.

10. A printing machine as set forth in claim 7 in which the wringer roller is provided with a peripheral cover comprising polytetrafluoroethylene.

11. A printing machine, comprising:

a rotary blanket cylinder driven at a predetermined surface speed;

a frame movably mounted on the printing machine adjacent the cylinder;

a cleaning roller rotatably supported by the frame in a position for forming a first nip with the cylinder to perform a cleaning operation;

a wiper roller having an open-cell sponge cover rotatably supported by the frame in contact with the cleaning roller and forming a second nip therewith;

means for continuously rotating both of said cleaning and wiper rollers at speeds such that the difference in surface speed at the first nip is at least about 200 cm/sec and the difference in surface speed at the second nip is at least about 250 cm/sec;

a wringer roller continuously rotating and in compressing engagement with the sponge cover of the wiper roller for preventing accumulation of deposits on the surface thereof; and means for applying cleaning fluid to the surface of said wringer roller.

12. A printing machine, comprising:

a rotary blanket cylinder driven at a predetermined surface speed;

a frame movably mounted on the printing machine adjacent the cylinder;

a cleaning roller rotatably supported by the frame in a position for forming a first nip with the cylinder to perform a cleaning operation;

a wiper roller having an open-cell sponge cover rotatably supported by the frame in contact with the cleaning roller and forming a second nip therewith;

a metering roller in fluid metering contact with the cleaning roller and in mutual cleaning contact with the wiper roller;

means for continuously rotating both of said cleaning and wiper rollers at speeds such that the difference in surface speed at the first nip is at least about 200 cm/sec and the difference in surface speed at the second nip is at least about 250 cm/sec;

a wringer roller continuously rotating and in compressing engagement with the sponge cover of the wiper roller; and means for applying cleaning fluid to the surface of said wringer roller.

13. A printing machine, comprising:

a rotary blanket cylinder driven at a predetermined surface speed;

a frame movably mounted on the printing machine adjacent the cylinder;

a cleaning roller rotatably supported by the frame in a position for forming a first nip with the cylinder to perform a cleaning operation;

a wiper roller having an open-cell sponge cover rotatably supported by the frame in contact with the cleaning roller and forming a second nip therewith;

means for continuously rotating both of said cleaning and wiper rollers at speeds such that the difference in surface speed at the first nip is at least about 200 cm/sec and the difference in surface speed at the second nip is at least about 250 cm/sec;

cleaning means comprising a continuously rotating roller having a substantially non-compressible surface in rubbing surface contact with the wiper roller for preventing accumulation of deposits on the surface thereof; and means for supplying cleaning fluid to the surface of said cleaning roller.

14. A method of cleaning the blanket cylinder of a printing machine in which the cylinder is driven at a predetermined surface speed, comprising the steps of:

providing a cleaning roller rotatably supported at a position for forming a first nip with the cylinder to perform a cleaning operation;

providing a wiper roller having an open-cell sponge cover rotatably supported in contact with the cleaning roller and forming a second nip therewith;

continuously rotating both of said cleaning and wiper rollers at speeds such that the difference in surface speeds of the rollers at each nip is at least about 200 cm/sec;

providing cleaning means including a continuously rotating roller having a substantially non-compressible surface in rubbing surface contact with the wiper roller for preventing accumulation of deposits on the surface thereof; and supplying cleaning fluid to the surface of the cleaning roller.

15. A method as set forth in claim 14 further comprising the steps of:

driving the cylinder in a predetermined direction of rotation; and rotating the cleaning roller and the wiper roller in said predetermined direction of rotation such that the surfaces of the rollers or roller and cylinder at each nip are moving in opposite directions.

16. A printing machine, comprising:

a rotary blanket cylinder driven in a predetermined direction and at a predetermined surface speed;

a frame movably mounted on the printing machine adjacent the cylinder for controlled movement;

a cleaning roller rotatably supported by the frame in a position for forming a first nip with the cylinder to perform a cleaning operation;

a wiper roller having an open-cell sponge cover rotatably supported by the frame in contact with the cleaning roller and forming a second nip therewith;

a wringer roller supported by the frame for continuous rotation and having a substantially non-compressible surface in rubbing surface contact with the wiper roller for preventing accumulation of deposits on the surface thereof;

a metering roller in contact with the cleaning and wiper rollers and frictionally driven by the cleaning roller;

means mounted on the frame for rotatably supporting the metering roller;

drive means for continuously rotating both of said cleaning and the wiper rollers in said predetermined direction of rotation such that the surfaces of the rollers or roller and cylinder at each of said nips are moving in opposite directions, said drive means rotating the cleaning roller and the wiper roller at speeds such that the difference in surface speeds of the rollers or roller and cylinder at each of said nips is at least about 200 cm/sec;

means for pivoting the frame between an inactive position in which the cleaning roller is out of contact with the cylinder and an active position to move the cleaning roller into contact with the cylinder;

means for supplying cleaning fluid to the surface of the wringer roller during cleaning operation;

trough means for draining contaminated cleaning fluid resulting from a cleaning operation of the cylinder; and means for receiving the contaminated fluid, settling the contaminants therefrom, and recycling the same to supply substantially uncontaminated cleaning fluid to the wringer roller for each cleaning operation of the cylinder.

* * * * *